US009566460B2

(12) United States Patent
Bacchin

(10) Patent No.: US 9,566,460 B2
(45) Date of Patent: Feb. 14, 2017

(54) EQUIPMENT FOR THE REMOTE CONTROL OF FIRE EXTINGUISHERS AND/OR HYDRANTS

(71) Applicants: TEXA S.P.A., Monastier di Treviso (IT); Paolo Bacchin, Preganziol (IT)

(72) Inventor: Paolo Bacchin, Preganziol (IT)

(73) Assignees: Texa S.P.A., Monastier Di Treviso (IT); Paolo Bacchin, Preganziol (IT)

( * ) Notice: Subject to any disclaimer, the term of this patent is extended or adjusted under 35 U.S.C. 154(b) by 0 days.

(21) Appl. No.: 14/655,029

(22) PCT Filed: Dec. 28, 2012

(86) PCT No.: PCT/IT2012/000405

§ 371 (c)(1),
(2) Date: Jun. 23, 2015

(87) PCT Pub. No.: WO2014/102838

PCT Pub. Date: Jul. 3, 2014

(65) Prior Publication Data

US 2015/0328488 A1 Nov. 19, 2015

(51) Int. Cl.

| | |
|---|---|
| ***A62C 13/00*** | (2006.01) |
| ***A62C 13/76*** | (2006.01) |
| ***A62C 37/50*** | (2006.01) |

(52) U.S. Cl.
CPC ..... *A62C 13/76* (2013.01); *A62C 37/50* (2013.01)

(58) Field of Classification Search
CPC ..... A62C 37/04; A62C 37/10; A62C 37/40; A62C 37/36
USPC ..... 169/61
See application file for complete search history.

(56) References Cited

U.S. PATENT DOCUMENTS

| | | | | |
|---|---|---|---|---|
| 5,848,651 | A | 12/1998 | McSheffrey et al. | |
| 2003/0116329 | A1 * | 6/2003 | McSheffrey | A61N 1/39 169/30 |
| 2006/0283608 | A1 | 12/2006 | Hauck | |

FOREIGN PATENT DOCUMENTS

| | | | |
|---|---|---|---|
| DE | 42 29 295 | A1 | 3/1994 |

OTHER PUBLICATIONS

International Search Report for PCT/IT2012/000405 dated Oct. 9, 2013.

* cited by examiner

*Primary Examiner* — Arthur O Hall
*Assistant Examiner* — Viet Le
(74) *Attorney, Agent, or Firm* — Arent Fox LLP

(57) ABSTRACT

An equipment for a remote control of fire extinguishers (10) and/or hydrants, comprising a valve group (16), equipped with a manometer and a pressure switch, which is able to control the operating pressure of the known fire extinguishers (10) and/or hydrants, wherein a plurality of microswitches (18, 19, 20), connected with a wireless transmitter (21), send the received signals to a remote central control unit (22), that is fully programmable locally or remotely and able to send alarms and/or warnings, depending on the programming carried out, to operators, persons in charge and/or maintainers of fire extinguishers (10) and/or hydrants.

7 Claims, 1 Drawing Sheet

EQUIPMENT FOR THE REMOTE CONTROL OF FIRE EXTINGUISHERS AND/OR HYDRANTS

CROSS-REFERENCE TO RELATED APPLICATIONS

This application is a National Stage entry of International Application No. PCT/IT2012/000405, filed Dec. 28, 2012. The disclosure of the prior application is hereby incorporated in its entirety by reference.

The present invention generally relates to an equipment for a remote control of fire extinguishers and/or hydrants.

More particularly, the invention relates to an apparatus for a remote control of portable or trolley fire extinguishers and/or water systems, such as fire hydrants, water hoses, etc.

Currently, 3 types of fire extinguishers and 3 types of hydrants are known; however, said types of fire extinguishers and/or hydrants have never technologically evolved over time, unless, with regard to the fire extinguishers, the extinguishing materials that are used, the size and the thicknesses of the enclosures, the technology of the valve units and related accessories, as well as, with regard to the water systems, the construction of the nozzles and the hoses.

Despite said improvements, if a fire extinguisher or a fire hydrant were tampered with, or for any technical reason, they lose the internal pressure, they could be completely useless in case of actual need; in fact, in this case, checks and periodic inspections and maintenance performed by the technical staff would be almost useless and other controls should be carried out almost daily.

In addition, current regular checks are still performed too infrequently (checks are normally carried out every 6 months) and, although they can be also carried out by the company's employees, the problem is not solved, because company's employees assigned for said checks are very often not fully qualified or they are not able to understand the operation and the integrity of the equipment, which, moreover, should be considered, by definition, a "first aid" equipment and therefore it should be usable in all emergency situations.

Fire extinguishers and hydrants which are currently known are the following:

portable and wheeled powder fire extinguishers pressurized at 14/15 bar with nitrogen;

$CO_2$ portable and wheeled fire extinguishers pressurized at 65 bar;

water portable fire extinguishers pressurized with nitrogen;

UNI 25 HOSE REEL hydrants;

UNI 45 hydrants;

UNI 70 hydrants.

Despite the differences among the products used for extinguishing fires, which are based on the extinguishing class, all the above mentioned fire extinguishers appear to have a common feature, namely, regardless the extinguishant material used, the fact that all the extinguishing fires are pressurized, even if at different pressures.

Therefore, if a fire extinguisher was partially used or tampered with or, for some technical reason, the internal pressure was lacking, said extinguisher would be completely unusable.

Moreover, even for hydrants (that are fed by a pump or from the aqueduct), analogously to the fire extinguishers, a steady control cannot be performed, because the use of a hydrant is immediately verified (obviously if someone is near the hydrant) since water comes out, but if said hydrant is unusable for technical reasons, such as the lack of water in the mains, the breakage of a pipe, a tampering, etc. . . . , this facts are not detectable until a qualified technician carries out the periodic check of the water plant.

Therefore, if it were possible to constantly keep under control the pressure of a fire extinguisher and/or a hydrant, it would also be possible to understand if said equipments are used or not used and, if necessary, to quickly act in order to ensure their efficiency.

Also, applying electronic control circuits and a suitable software, it can also be possible to immediately verify the status of the equipment and the action that was performed, in order to obviate human errors.

In regarding the above requirements, therefore, an object of the present invention is to overcome the drawbacks of the prior art and, in particular, to provide an equipment for a remote control of fire extinguishers and/or hydrants, which allows to continuously control the operating pressure of the fire extinguishers and hydrants in use, in order to instantly locate any malfunctions and provide for a maintenance, repair and/or replacement action.

Another object of the present invention is to provide an equipment for a remote control of fire extinguishers and/or hydrants, which allows to control an effective and correct maintenance action on fire extinguishers and/or hydrants in use, instantly verifying the status of each fire extinguisher and/or hydrant and the status of each action that was performed, so as to obviate to possible human errors.

A further object of the invention is to indicate an equipment for a remote control of fire extinguishers and/or hydrants, which is extremely reliable and efficient, as well as simple to made and to operate for any operator.

These and other objects are achieved, according to the present invention, by an equipment for a remote control of fire extinguishers and/or hydrants, according to the appended claim 1; other detailed features of the equipment are shown in the other dependent claims.

Advantageously, the equipment according to the present invention provides for using a suitable valve assembly, equipped with a manometer and a mini pressure-switch, which is able to control the operating pressure of the portable and/or wheeled fire extinguishers currently in use, as well as for applying a plurality of micro-switches, which, connected to a wireless transmitter similar to the transmitter used in civil and industrial burglar alarm systems, send the received signals to a suitable remote control central unit.

The same technical principle is also used for water systems, such as fire hydrants, water hoses, etc., whose control valve is connected with a manometer with a pressure-switch.

These and other objects and advantages will appear more clear from the description which follows, related to a preferred embodiment of the equipment for a remote control of fire extinguishers and/or hydrants, according to the present invention, which is described by way of example and as a preferred but not limited embodiment, and with reference to the attached drawings, wherein.

Figure 1:
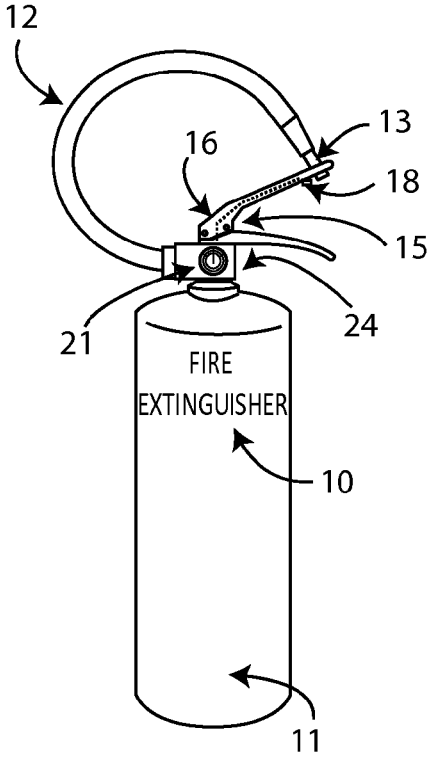
FIG. 1 is a schematic front view of a fire extinguisher device according to the state of the art.
Figure 2:
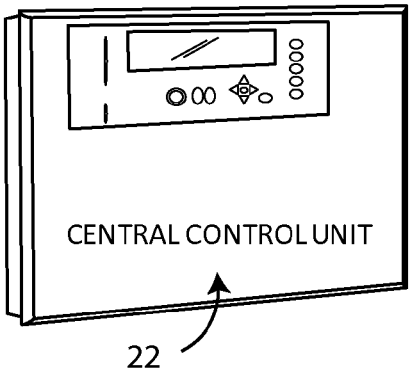
FIG. 2 is a schematic front view of a central control unit used in the equipment for a remote control of fire extinguishers and/or hydrants, according to the invention.
Figure 3:
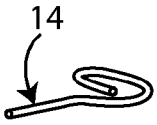
FIG. 3 shows a safety plug for a valve of the fire extinguisher of FIG. 1.
Figure 4:
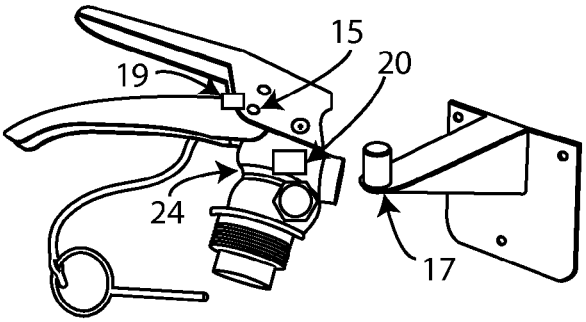
FIG. 4 shows an exploded view of a seat for housing a fire extinguisher bearing hook, suitable for placing the fire extinguisher of FIG. 1.
Figure 5:
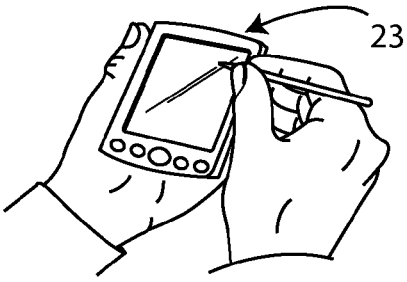
FIG. 5 shows an operative action which can be made by a technician for carrying out a periodic check of fire extinguishers, according to the present invention.

Firstly, It should be noted that, although the following description and the accompanying drawings explicitly refer to the use of an equipment for a remote control of fire extinguishers, the present invention can be similarly applied with the same technical principles to water systems, such as hydrants, fire hydrants, water hoses, etc.

With reference to the above mentioned figures, the reference character 10 refers to a known fire extinguisher device substantially comprising a containment body 11, a hose 12, a dispenser cone 13, a safety plug 14 for the valve 16 of the fire extinguisher 10 and the seat 24, located on the delivery nozzle and behind the valve 16 of the fire extinguisher 10, for housing the fire extinguisher bearing hook 17.

According to the present invention, a first micro-switch 18, placed near the dispenser cone 13 is provided for detecting the drawing of the hose 12 from its seat, a second micro-switch 19, which is able to control when the safety plug 14 is removed from its seat 15 for a possible use and/or for a possible tampering with the fire extinguisher device, a third micro-switch 20, placed in correspondence of the seat 24 for housing the fire extinguisher bearing hook 17, which is able to control the presence or the absence of the fire extinguisher 10 in its assigned seat, and a wireless transmitter 21, placed on the body 11 of the fire extinguisher 10, near the valve 16, and equipped with a manometer and a pressure-switch, to which the micro-switches 18, 19, 20 are connected.

The wireless transmitter 21 sends data received from the micro-switches 18, 19, 20, via radio, to the central control unit 22.

In particular, the wireless transmitter 21 is provided with at least four inputs, all programmable and divided as follows:

- a first input (NC or NA type), connected with the pressure-switch, which sends a signal to the central control unit 22 when the pressure inside the fire extinguisher 10 is greater than or less than a value or a range of prefixed threshold values;
- a second input (NC or NO type), which is used to control, via the micro-switch 20, when the portable fire extinguisher 10 is disengaged from its support 17; in this case, the micro-switch 20 transmits a signal to the central control unit 22, which is able to subsequently verify the reason of said disengagement (for example, removal of the fire extinguisher 10 due to a principle of fire or for replacing the fire extinguisher 10 in another place not assigned, etc.);
- a third input (NC or NO type), which is used to control the hose 12 together with the dispenser cone 13; in this case, the micro-switch 18 sends a signal to the central control unit 22 when the hose 12, together with the dispenser cone 13, is removed from its seat;
- a fourth input (NC or NO type), which is used to control the safety plug or pin 14; in this case, the micro-switch 19 sends a signal to the central control unit 22, when, for any reason (tampering or real need), the safety pin 14 is removed.

The central control unit 22 is the core of the system which is the object of the present invention and it is able to receive radio signals from different transmitters 21, which are placed on each fire extinguisher 10 and, as performed in anti-intrusion or antifire equipments, have automatic controls for verifying that the different transmitters 21 communicate to each other and transmit signals to the central control unit 22, so that, if there is a fault or any other failure (for example, a breakdown of a transmitter 21 battery), said failure is immediately signaled to the central control unit 22, which provides for sending the related alerts to the operator who is in charge of the maintenance of the whole system.

The central control unit 22 is also fully programmable, so that each incoming signal is customizable and identifiable (for example, it is possible to include, exclude and/or appoint the various inputs of the transmitter 21, so as to be able to configure an active or functional contact of the pressure-switch, as well as it is possible to exclude the micro-switch 20 which controls whether or not the fire extinguisher 10 is hanging on the hook 17, so as to avoid the sending of a signal alarm if the fire extinguisher 10 should, for some reason, be removed from its seat, as it would be still active the micro-switch that controls the pressure-switch and in any case the operator would be aware of the situation).

Therefore, the central control unit 22 sends the suitable alarms and alerts, depending on the programming performed by the operator, by the company managers and/or by the fire extinguishers maintainers, so as to be able to act, in any case, in an appropriate manner.

In more complex equipments, such as the equipments installed in hospitals, community, etc. and in any case in large buildings where the amount of fire extinguishers 10 and of hydrants is distributed in various environments and/or on different floors, in addition to the central control unit 22, which is sized for said amount of fire extinguishers and hydrants, further satellite control sub-units must be installed, which are provided for receiving signals from the different attributable transmitters 21.

For example, a satellite control sub-unit can receive signals of the fire extinguishers 10 or hydrants of an entire floor and then send commands related to a central unit, which will be able to identify the source of the alarms coming from the different satellite sub-units that are spread in the building.

The central unit will be provided with an electronic circuit, which can be programmed via an external PC, both on-site, by means of suitable connectors, and remotely, via Internet and by using a suitable software and password, with which the central unit, the transmitters 21 and the different features of said transmitters can be configured.

Therefore, the maintenance companies and the safety officers of the various buildings are able to continuously control the different devices and to instantly act if a problem occurs, with obvious advantages for the safety.

The present invention allows to remotely control all the fire extinguishers and/or hydrants of various customers, as well as the maintenance companies may also use a hand-held terminal 23, wireless or connected, via a cable connection, with the transmitter 21 placed on the fire extinguisher 10 or hydrant, so that the safety operator responsible for the periodic maintenance (which is normally carried out every 6 months) is able to perform the various checks, as required by law, thus certainly performing all the planned maintenance checks; in fact, the specialized technician who must perform the periodical maintenance of the fire extinguishers 10 can directly interact, by means of the special hand-held terminal 23, with each transmitter 21 placed on each fire extinguisher 10, as well as with the central control unit 22, in order to certify the proper maintenance.

The maintenance company can also control checks and maintenance operations which have been performed and recorded on the hand-held 23, by directly controlling the screen of the hand-held 23 or by checking the maintenance status on-line, via Internet.

For example, when the technician has to control a portable fire extinguisher 10, for example a powder fire extinguisher, he/she has only to connect the hand-held 23, through the proper plug or via wireless, with the transmitter 21 of the fire extinguisher 10, in order to visualize on the graphic display of said hand-held device 23 all technical data of said fire extinguisher, such as the type of fire extinguisher, the quantity of extinguishing agent, the place where the fire extinguisher is positioned, etc.

It is thus possible to uniquely and precisely identify the fire extinguisher that has to be verified, as well as it is possible, once the fire extinguisher has been identified, to display the different planned due dates, such as the expiry of the periodic control, the expiry of the revision, the expiry of testing, etc., so that the technician can perform the operation indicated by the hand-held device 23 that is equal to the operation indicated in the maintenance card, which is provided by law and which is hanging on each fire extinguisher.

Assuming that the operation to perform is the priodic control, the technician may perform different planned controls, such as, for example, the weight control, the pressure control, the fire hose control, etc.

All these operations are also verifiable, because, for example, the fire hose can be controlled by removing the hose from its seat and this operation (as well as all the operations provided by law), as described above, will be signaled from the transmitter 21 and then recorded on the hand-held device 23.

Advantageously, it is possible to certainly know the company performing the maintenance and the technician who is carrying out the checks, the type of said checks, if the checks or the operations are the right ones, and once completed said checks, it is possible to confirm the maintenance operations.

In addition, using a specific software installed in one or more PC, it is also possible to automatically billing the customer, thus avoiding mistakes and saving time and being sure that all the planned tests are actually made, thus obtaining both the safety of the maintenance company and the safety of the customer.

If the company is small or without ADSL line, the equipment can be connected to known GSM, UMTS, HSDPA modem, which use the lines of common mobile phones with the same functionality of a traditional phone line.

Additionally, always using the suitable software, once the maintenance operations are carried out, it is possible to automatically fill an electronic form reporting said maintenance operations (already required by law, even if in paper form), so that the form is always updated; the form is also verifiable online, at any time, even by the authorities, with the additional advantage of protecting the environment from the waste of paper.

It was thus verified, as above described, that the equipment of the present invention can be used in all buildings, both large and small, where fire extinguishers and/or hydrants that should be subject to periodical maintenance checks are installed; moreover, in case of large buildings, where there are many fire extinguishers and/or hydrants, it is possible to control and ensure a higher reliability of said emergency devices, thus obtaining a certain appreciation by the authorities responsible for periodical checks, such as the Fire Department, which are always sensitive to all the improvements that help to give more safety, both in private and public buildings and places, in order to avoid dangerous situations.

From the above description the technical characteristics of the equipment for a remote control of fire extinguishers and/or fire hydrants, which is the object of the present invention, are clear, as well as the related above mentioned advantages.

Finally, it is clear that other embodiments of the equipment may be provided, without departing from the principles of novelty inherent in the inventive idea as claimed in the appended claims, as well as it is clear that, in the practical embodiment of the invention, the materials, shapes and dimensions of the details illustrated may be any according to requirements and said details may be replaced with other technically equivalent ones.

The invention claimed is:

1. Equipment for the remote monitoring of fire extinguishers (10) and/or hydrants, comprising:

a plurality of fire extinguishers (10) and/or hydrants which include at least one valve group (16) and at least one dispensing device (12, 13) for spraying a substance, wherein at least one first micro-switch (18, 19, 20) is placed at said dispensing device (12, 13), said first micro-switch (18, 19, 20) being connected to at least one transmitter (21), which is associated with at least one respective fire extinguisher (10) and/or hydrant and connected, in turn, with at least one pressure switch and/or with at least one manometer and able to send, via radio, data and/or signals received by at least said first micro-switch (18, 19, 20) to a central control unit (22), that is fully programmable locally or remotely and able to send alarms and/or warnings, which depend on the programming carried out, to operators, persons in charge and/or maintainers of fire extinguishers (10) and/or hydrants, characterized in that said dispensing device (12, 13) includes at least one hose (12) for delivering said substance to be sprayed and at least one cone nozzle or dispenser (13), at least one second micro-switch (18, 19, 20) being placed near said cone nozzle (13) for detecting the removal of said hose (12) from its seat; and wherein at least one locking plug or pin (14) is placed near said valve group (16) and at least one third micro-switch (18, 19, 20) is placed next to said locking pin (14), in order to check when said pin (14) is removed from its housing (15).

2. Monitoring equipment as claimed in claim 1, characterized in that at least one seat (24) is provided on said dispensing device (12, 13) and behind said group valve (16) for inserting at least one support hook (17), and at least a further micro-switch (20) is placed next to said seat (24), and configured to verify the presence or absence of said fire extinguisher (10) and/or hydrant in an assigned location.

3. Monitoring equipment as claimed in claim 1, characterized in that said transmitter (21) comprises a plurality of programmable inputs, of which at least one first input is connected with said manometer, configured to send a signal to said control unit (22) when the pressure within said fire extinguisher (10) and/or hydrant is greater than or less than a value or a range of predetermined threshold values.

4. Monitoring equipment as claimed in claim 1, characterized in that at least one second input of said transmitter (21) is used to control, via at least one of said micro-switches (20), when said fire extinguisher (10) and/or hydrant is removed from its support hook (17).

5. Monitoring equipment as claimed in claim 1, characterized in that at least one third input of said transmitter (21) is configured to control said dispensing device (12, 13) and at least one fourth input of said transmitter (21) is configured to control said locking pin (14).

6. Monitoring equipment as claimed in claim 1, characterized in that satellite control sub-units are installed between said transmitters (21) and said control and/or operating unit (22), said satellite control sub-units receiving signals from said transmitters (21) and sending commands to said central control unit (22), which is configured to identify the source of the commands of said satellite control sub-units.

7. Monitoring equipment as claimed in claim 1, characterized in that each transmitter (21) is connected to at least one terminal (23), and are configured to provide a status to operators carrying out a maintenance of said fire extinguishers (10) and/or hydrants by providing the status on a display of said terminal (23).

* * * * *